United States Patent [19]

Smith, II et al.

[11] Patent Number: 4,989,013

[45] Date of Patent: Jan. 29, 1991

[54] MULTIFREQUENCY ANTENNA HAVING A DC POWER PATH

[75] Inventors: Frank P. Smith, II, Dresher; Thomas R. Krishan, Newtown Square, both of Pa.; Hugh P. McAdams, Jr., Port Deposit, Md.

[73] Assignee: Litton Systems, Inc., Springfield, Pa.

[21] Appl. No.: 332,208

[22] Filed: Mar. 31, 1989

[51] Int. Cl.[5] ..... H01Q 1/06

[52] U.S. Cl. ..... 343/721; 343/749; 343/708

[58] Field of Search ..... 343/721, 722, 709, 702, 343/710, 795, 825, 827, 700 MS, 708, 749

[56] References Cited

U.S. PATENT DOCUMENTS

| | | | |
|---|---|---|---|
| 1,892,253 | 12/1932 | Schelleng | 343/827 |
| 1,967,881 | 7/1934 | Green | 343/827 |
| 2,153,975 | 4/1939 | Smith et al. | 343/721 |
| 2,163,743 | 6/1939 | Berndt | 343/749 |
| 3,774,221 | 11/1973 | Francis | 343/749 |
| 4,039,894 | 8/1977 | Gardner | 343/721 |
| 4,072,952 | 2/1978 | Demko | 343/770 |

*Primary Examiner*—Rolf Hille
*Assistant Examiner*—HoangAnh Le
*Attorney, Agent, or Firm*—Brian L. Ribando

[57] ABSTRACT

A plural frequency antenna includes a plurality of antenna segment pairs, one for each frequency which is to be transmitted. The segment pairs are serially connected to one another and form a conductive path for DC current which charges a capacitor used to fire a strobe lamp mounted on the top of the antenna.

19 Claims, 2 Drawing Sheets

MULTIFREQUENCY ANTENNA HAVING A DC POWER PATH

BACKGROUND OF THE INVENTION

This invention relates to a plural frequency antenna used in an emergency position indicating radio beacon.

Emergency position indicating radio beacons (EPIRBs) are intended for use by mariners in an emergency situation. According to international agreements, the EPIRB transmits a homing signal on 121.5 mhz only or on both 121.5 and 243 mhz, as well as a satellite beacon signal on 406 mhz. In the event of an accident at sea or other distress situation, the EPIRB is manually deployed or, in the event there is no opportunity for manual deployment, automatically deployed in order to transmit the homing and satellite signal frequencies. The 121.5 mhz and 243 mhz signals are transmitted to ground based and other rescue facilities. Air and sea search and rescue (SAR) vehicles are able to home-in on the signals and thus locate the EPIRB and those in distress.

The EPIRB also transmits a 406 mhz identification signal which is received by a search and rescue satellite-aided tracking (SARSAT) satellites which are in orbit around the earth. The SARSAT is able to determine the position coordinates of the EPIRB by doppler shift techniques and to transmit the position of the EPIRB to one of several ground receiving stations located around the globe. The ground receiving station relays the position coordinates of the EPIRB as well as identification information relating to the vessel to which the EPIRB is assigned to a Mission Control Center (MCC). The MCC sends the location of the EPIRB to a rescue coordination center which deploys ships, planes, or helicopters as appropriate to the EPIRB site in order to provide rescue operations.

The EPIRB itself is housed in a buoy which is designed to float on the surface of the water. The upper portion of the buoy includes an antenna cone which contains the transmitting antenna for the buoy; and in order to aid in visual location of the EPIRB in the water by the SAR vehicles, the tip of the antenna cone is provided with a light. In order to function properly, the EPIRB antenna must efficiently transmit the three signals at 121.5, 243, and 406 mhz as well as provide DC power to the lamp on the top of the antenna.

SUMMARY AND OBJECTS OF THE INVENTION

A plural frequency antenna comprises a plurality of antenna segments, one for each frequency which is to be transmitted. The plurality of segments each have a length which is chosen for efficient transmission of a particular frequency and are connected in series to provide a continuous electrical path. Segment pairs are mounted on opposite sides of a printed circuit board. Capacitive coupling between the segments allow the elements to act as a single element for AC transmission and at the same time create separate direct current paths for DC power which is required by the lamp mounted on top of the antenna cone.

It is accordingly an object of the invention to provide an antenna which may be used for plural frequency AC transmission.

It is another object of the invention to provide a plural frequency antenna which may be used for plural frequency AC transmission as well as transmission of DC power to a light mounted on one end of the antenna.

It is another object of the invention to provide a plural frequency antenna which functions as a DC power conductor for a lamp on an emergency locating beacon.

These and other objects of the invention will become apparent from the following detailed description of the invention in which reference numerals used throughout the description correspond to reference numerals shown on the accompanying drawing figures.

DESCRIPTION OF THE PREFERRED EMBODIMENT

Figure 1:
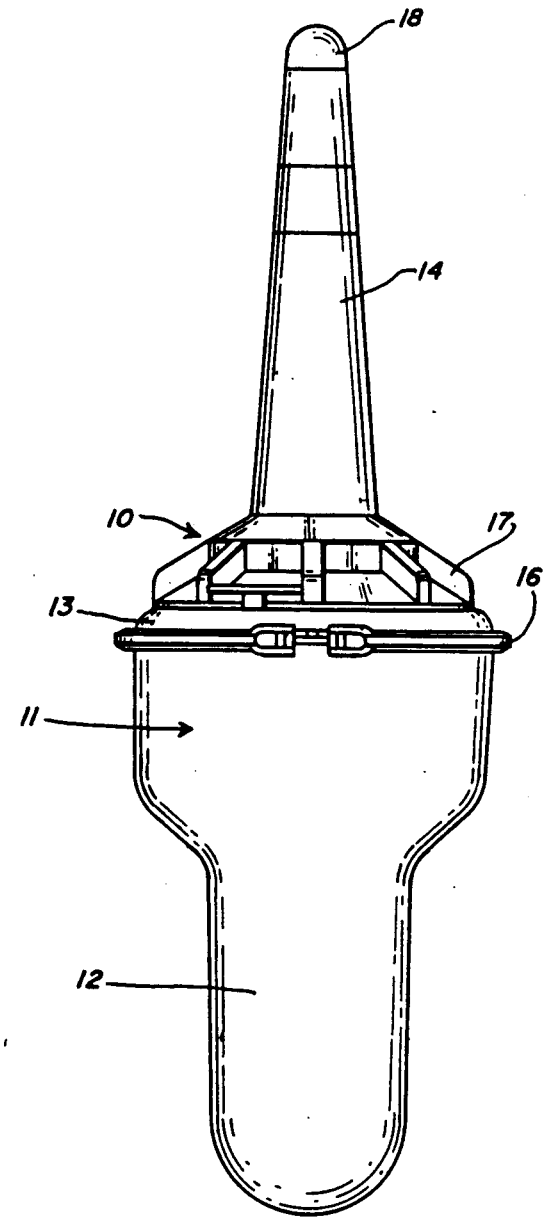
FIG. 1 is a front view of an emergency position indicating radio beacon.

Referring to FIG. 1, there is shown an emergency position indicating radio beacon (EPIRB) generally designated by the reference numeral 10.

The EPIRB comprises a buoy body 11 including a generally cylindrical lower housing portion 12, a middle deck portion 13, and an upper slender antenna cone 14. The housing portions may be manufactured from any suitable waterproof structurally sound material such as plastic, although other material such as metal may be used. The lower housing portion 12 contains a battery pack and various electrical circuits (not shown) necessary for the operation of the buoy as a transmitter beacon and is held to the middle deck portion 13 by a clamping ring 16 which is removable to allow access to the interior of the housing portion 12. The middle deck portion 13 may comprise a switch ring 17 or other controls which are used in the operation of the buoy. The antenna cone 14 surrounds and protects the antenna for the buoy and terminates in a lens 18 which covers and protects an illumination device as seen on FIG. 2.

Figure 2:
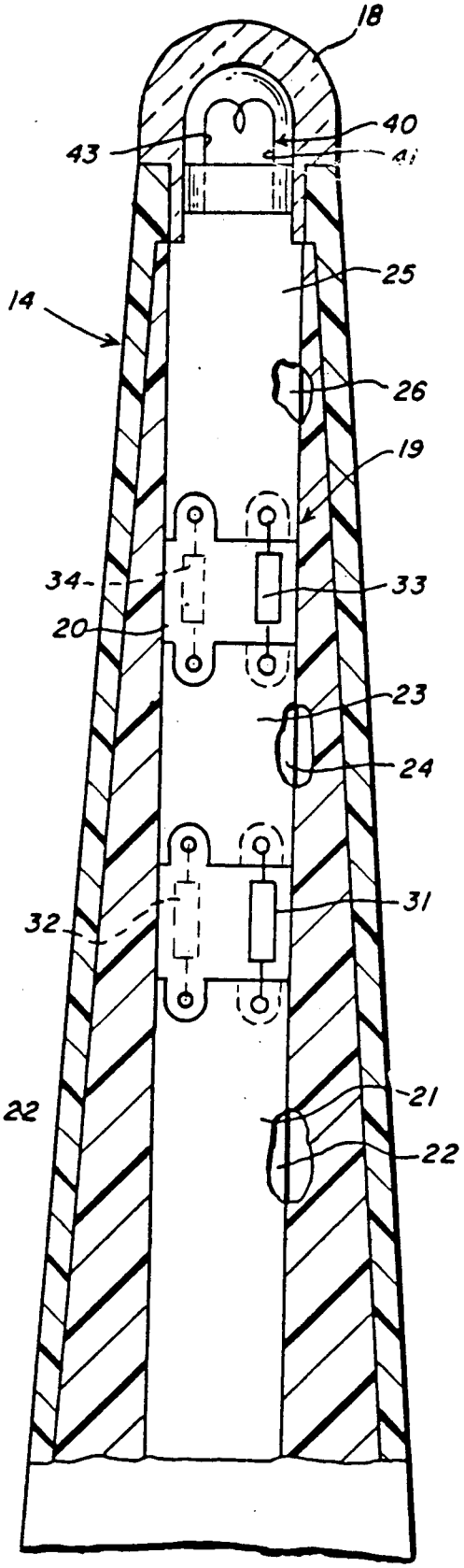
FIGS. 2 and 3 are front and side views, respectively, of the antenna used in the beacon of FIG. 1.
Figure 3:
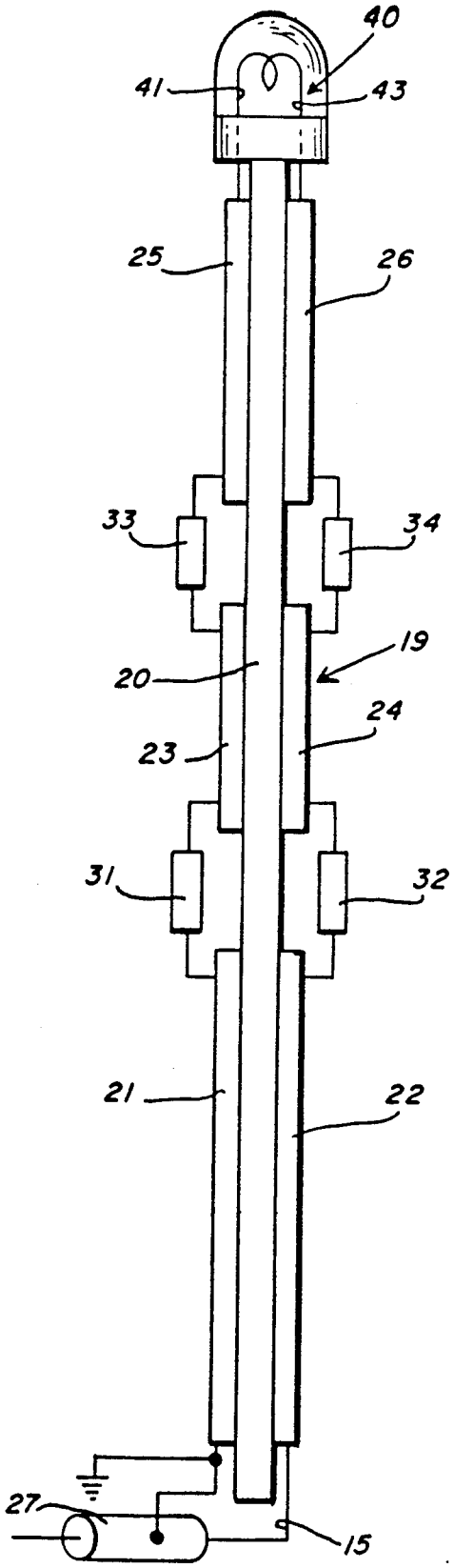

Turning now to FIGS. 2 and 3, a structure of the antenna located within the antenna cone 14 is shown in specific detail. The antenna is a monopole design and comprises a printed circuit board 20 on which is mounted first, second, third, fourth, fifth, and sixth antenna segments 21, 22, 23, 24, 25, and 26, respectively. As shown in FIG. 3, the antenna segment 22 is coupled to the signal lead 15 of a transmission line 27 and the segment 21 is coupled to the ground plane. The antenna segments 21 and 23 are coupled together by a first inductor 31, antenna segments 22 and 24 are coupled together by a second inductor 32, antenna segments 23 and 25 are coupled together by a third inductor 33, and the antenna segments 24 and 26 are connected together by a fourth inductor 34. It is well known in the art that inductors together with their stray capacitance form a resonant circuit to block the transmission of signals having certain frequencies, while at the same time allowing the passage of signals having lower frequencies. The antenna segments positioned opposite one another on the printed circuit board are separated only the thickness of the board. This small separation creates a capacitive coupling between the antenna segments which allows opposing segments to radiate certain frequencies as a single segment. Accordingly, antenna segments 21 and 22 when properly dimensioned may be used to radiate a signal at 406 mhz.

The coupling inductors 31 and 32 between the antenna segments 21 and 23, and 22 and 24, respectively, allow certain frequencies to pass without appreciable attenuation. Since the antenna segments 21 and 23 are capacitively coupled to segments 22 and 24, respectively, by the spacing therebetween provided by the printed circuit board 20, they are able to radiate certain frequencies as a single element. As a result, the antenna segments 21, 22, 23, and 24 may be used to transmit a signal of 243 mhz.

In similar fashion, the coupling inductors 33 and 34 between antenna segments 23 and 25, and 24 and 26, respectively, allow certain frequencies to pass without appreciable attenuation. The antenna segments 25 and 26 are spaced from one another by the thickness of the printed circuit board 20 and, as a result, are capacitively coupled to one another. This allows the antenna elements 25 and 26 to radiate as a single element; and in conjunction with the coupling effect of the inductors 33 and 34, the antenna segment 21, 22, 23, 24, 25, and 26 may be used together to radiate a signal having a frequency having 121.5 mhz.

The capacitive coupling between the antenna segments on opposite sides of the printed circuit 20 is an effective block for DC current or signals having a very low frequency. As a result, the antenna segments 21, 23, and 25 which are serially coupled together by the inductors 31 and 33 may be used to provide DC power to the first lead 41 of an illumination device 40 located at the peak of the antenna. Similarly, the antenna segments 22, 24, and 26 coupled together by the inductors 32 and 34 may be used as a return path for DC power through the illumination device 40 and from the second lead 43. In this way, direct current may be supplied to the direct current lamp 40 along the length of the antenna 19 without the necessity of running separate leads along the antenna, thus interfering with the normal radiation pattern of the antenna.

Connecting the lamp 40 and the lamp leads 41 and 43 to the radiating elements 25 and 26 of the antenna causes the lamp 40 and the leads 41 and 43 to become a part of the antenna radiating structure. Accordingly, the radiating length of the elements 25 and 26 is increased by the addition of the lamp and the leads; and this lengthening effect must be taken into account when determining the physical size of elements 25 and 26 in order to radiate the 121.5 mhz signal.

If required for greater visibility, the illumination device 40 may comprise a strobe lamp of the xenon gas type. In this instance, a strobe circuit for the lamp may be positioned on the antenna in the region of the radiating elements 25 and 26.

Figure 4:
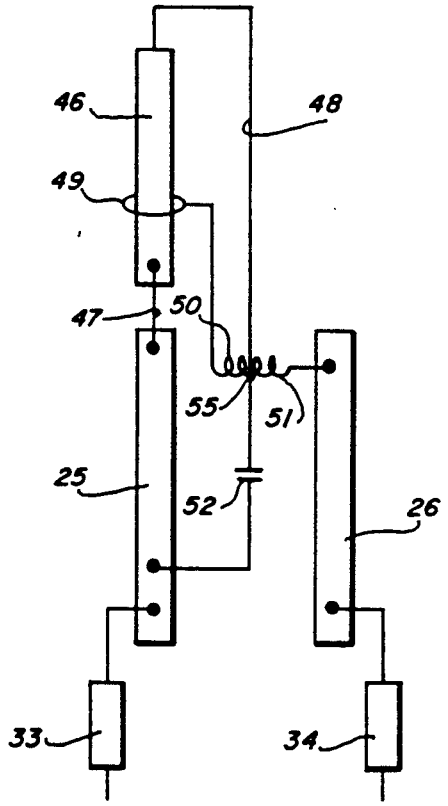
FIG. 4 is a schematic diagram showing an alternate embodiment of the invention.

FIG. 4 is a schematic diagram showing a portion of the antenna structure and the power and firing circuit for the strobe lamp 46. As shown, a first lead 47 of the lamp 46 is coupled to the radiating elements 25; and the second lead 48 is coupled to a transformer tap 55. A firing electrode 49 around the lamp 46 is coupled to a first side 50 of an auto step-up transformer, the second side 51 of which is coupled to the radiating element 26. The tap 55 on the transformer is coupled to a charging capacitor 52 which is coupled to the radiating element 25. As in the embodiment shown in FIGS. 2 and 3, the lamp 46, the leads 47 and 48, and the associated circuitry are a part of the radiating structure of the antenna.

In use, an RF signal fed to the antenna will be radiated by the antenna; and at the same time, a DC charging current fed to the antenna will charge the capacitor 52. At an appropriate time, the two sides of the antenna are shorted together by circuitry at the base of the antenna (not causing the capacitor 52 to discharge. The autotransformer develops a high voltage on trigger electrode 49, causing the strobe lamp 46 to ionize and turn on. The ionizing of the lamp 46 discharges the capacitor 52 until the voltage on capacitor 52 is too low to maintain the lamp 46 on. When the lamp 46 turns off, the DC charging current applied to the antenna causes the capacitor to begin to recharge. In actual practice, the strobe lamp 46 will flash every 3 second period.

In an alternate embodiment (not shown), the antenna may comprise parallel wires or parallel wire-like traces on a printed circuit board rather than wide plate-like radiating elements. The parallel- or wire-like traces will be electromagnetically coupled to one another and will radiate as a single unit. In the embodiment in which wire-like traces are formed on a printed circuit board, the traces may be located either on the same or on opposite sides of the board.

Having thus described the invention, various alterations and modifications thereof will occur to those skilled in the art, which alterations and modifications are intended to be within the scope of the invention as defined by the appended claims.

What is claimed is:

1. An antenna for transmitting plural frequency signals comprising:

first and second antenna segments each having a length A for optimal transmission of a signal having a frequency A;

third and fourth antenna segments each having a length B;

a first inductor coupling the first and third segments in series for optimal rejection of the frequency A signal a second inductor coupling the second and fourth segments in series for optimal rejection of the frequency A signal;

a capacitive coupling between the first and second antenna segments allowing the first and second segments to radiate the frequency A signal as a single segment;

a capacitive coupling between the third and fourth antenna segments allowing the first and third segments and the second and fourth segments to transmit a signal having a frequency B as a single segment;

a single antenna lead coupled to the second antenna segment coupling plural frequency signals to the antenna; and an illumination device having first and second leads, wherein the first lead is coupled to the third segment and the second lead is coupled to the fourth segment, whereby a first direct current path is formed comprising the single lead, the first segment, the first inductor, the third segment and the first lead, and whereby a second direct current path is formed comprising the second lead, the fourth segment, the second inductor, and the second segment.

2. The antenna of claim 1 further comprising:

a printed circuit board comprising a support for the antenna segments.

3. The antenna of claim 2 further comprising:

conductive areas printed on the printed circuit board comprising the antenna segments.

4. The antenna of claim 3 wherein the first and second antenna segments are printed on opposite sides of the printed circuit board and are separated from one another by the thickness of the printed circuit board;

the third and fourth antenna segments are printed on opposite sides of the printed circuit board and are separated from one another by the thickness of the board; and the first and third antenna segments are positioned on one side of the printed circuit board, and the second and fourth antenna segments are positioned on the other side.

5. The antenna of claim 4 wherein the printed circuit board has an elongated shape, and the first and third antenna segments each have a rectangular shape and are positioned end to end with respect to one another along the length of the printed circuit board.

6. The antenna of claim 5 wherein the illumination device is mounted on one end of the elongated printed circuit board.

7. The antenna of claim 5 wherein the separation caused by the printed circuit board between the first and second antenna segments and between the third and fourth antenna segments creates the capacitive coupling between the said segments.

8. The antenna of claim 6 wherein the illumination device is a strobe lamp which flashes briefly at periodic intervals.

9. The antenna of claim 8 further comprising:

a strobe circuit for the strobe lamp, wherein the strobe circuit is mounted on the printed circuit board adjacent the strobe lamp.

10. An antenna for transmitting plural frequency signals comprising:

first and second antenna segments each having a length A for optimal transmission of a signal having a frequency A;

third and fourth antenna segments each having a length B;

a first inductor coupling the first and third segments in series for optical rejection of the frequency A signal;

a second inductor coupling the second and fourth segments in series for optimal rejection of the frequency A signal;

a capacitance coupling between the first and second antenna segments allowing the first and second segments to radiate the frequency A signal as a single segment;

a capacitive coupling between the third and fourth antenna segments allowing the first and third segments and the second and fourth segments to transmit a signal having a frequency B as a single segment;

a single antenna lead coupled to the second antenna segment coupling plural frequency signals to the antenna;

fifth and sixth antenna segments each having a length C;

a capacitive coupling between the fifth and sixth antenna segments allowing the fifth and sixth antenna segments to transmit as a single element;

a third inductor coupling the fifth antenna segment to the third antenna segment for the optimal rejection of the frequency B signal; and a fourth inductor coupling the sixth antenna segment to the fourth antenna segment for optimal rejection of the frequency B signal.

11. The antenna of claim 10 further comprising:

an illumination device having first and second leads, wherein the first lead is coupled to the fifth segment and the second lead is coupled to the sixth segment, whereby a first direct current path is formed comprising the first, third, and fifth segments, the first and third inductors, and the first lead, and whereby a second direct current path is formed comprising the second lead, the sixth, fourth, and second segments, and the fourth and second inductors.

12. The antenna of claim 11 further comprising:

a printed circuit board comprising a support for the antenna segments.

13. The antenna of claim 12 further comprising:

conductive areas printed on the printed circuit board comprising the antenna segments.

14. The antenna of claim 13 wherein the first and second antenna segments are printed on opposite sides of the printed circuit board and are separated from one another by the thickness of the printed circuit board;

the third and fourth antenna segments are printed on opposite sides of the printed circuit board and are separated from one another by the thickness of the board;

the fifth and sixth antenna segments are printed on opposite sides of the printed circuit board and are separated from one another by the thickness of the board; and the first, third, and fifth antenna segments are positioned on one side of the printed circuit board, and the second, fourth, and sixth antenna segments are positioned on the other side.

15. The antenna of claim 14 wherein the printed circuit board has an elongated shape, and the first, third, and fifth antenna segments each have a rectangular shape and are positioned end to end with respect to one another along the length of the printed circuit board.

16. The antenna of claim 15 wherein the illumination device is mounted on one end of the elongated printed circuit board.

17. The antenna of claim 16 wherein the illumination device is a strobe lamp which flashes briefly at periodic intervals.

18. The antenna of claim 17 further comprising: a strobe circuit for the strobe lamp, wherein the strobe circuit is mounted on the printed circuit board adjacent the strobe lamp.

19. The antenna of claim 15 wherein the separation caused by the printed circuit board between the first and second antenna segments, between the third and fourth antenna segments, and between the fifth and sixth antenna segments creates the capacitive coupling between the said segments.

* * * * *